US006431729B1

(12) United States Patent
Chen

(10) Patent No.: US 6,431,729 B1
(45) Date of Patent: Aug. 13, 2002

(54) DECORATIVE LIGHTING STRING WITH FILLING AIR TYPE

(75) Inventor: W. T. Chen, Hsin-Chu (TW)

(73) Assignee: Willis Electric Co., Ltd., Hsin-Chu (TW)

( * ) Notice: Subject to any disclaimer, the term of this patent is extended or adjusted under 35 U.S.C. 154(b) by 0 days.

(21) Appl. No.: 09/710,302

(22) Filed: Nov. 9, 2000

(30) Foreign Application Priority Data

Jan. 27, 2000 (CN) ..... 00201439.4

(51) Int. Cl.[7] ..... F21V 21/00

(52) U.S. Cl. ..... 362/249; 362/253; 362/806; 362/808; 446/219

(58) Field of Search ..... 362/249, 252, 362/253, 806, 808; 446/219, 220

(56) References Cited

U.S. PATENT DOCUMENTS 3,835,308 A * 9/1974 Reese ..... 240/10
4,179,832 A * 12/1979 Lemelson ..... 40/540
6,276,815 B1 * 8/2001 Wu ..... 362/234

* cited by examiner

*Primary Examiner*—Sandra O'Shea
*Assistant Examiner*—Ali Alavi

(57) ABSTRACT

The present invention generally relates with filling air string unit in decorative lighting string. This filling air string which to make the lighting string to expandable or to shrinkable with lighting device and the firm device. This filling air string is made up from soften plastics which has a filling air room. The lighting string will made up into many different kind of shapes when volume expansion when expand and sufficient the air. The lighting string will minimize the volume when emit the air. This filling air volume has a gas room in the central that has some capacity for this lighting device. As this lighting device firm in the central of this gas room to be able to reveal any kind of shapes and clearly to showing the lighting string while rising this filling air string.

1 Claim, 4 Drawing Sheets

DECORATIVE LIGHTING STRING WITH FILLING AIR TYPE

BACKGROUND OF THE INVENTION

The present invention relates to a structure of decorative expand filling air lighting string and consists of expand and shrink filling air body, lighting device and firm device. Generally relates to an expandable, shrinkable and three-dimensional lighting string unit in sufficient decorative lighting string structure.

Generally, the decorative lighting string is used around a tree, window or door, or pre-arranged on a decorative sheet or a stand. Such lighting strings are only a simply decorative lighting string. Some of the conventional lighting strings are arranged on three-dimensional body. All of them are not any variance. Further, the packages of them are huge volume so that the transportation and store are not so easy. Thus, the cost will be increased so as to reduce the customer's purchasing ability.

SUMMARY OF THE INVENTION

The objective for this present invention is to provide an expandable and shrinkable filling air decorative lighting string which let the lighting string device in side the firm device and showing many kind of shapes by lighting device after expand filling air body.

Further, the present invention can be expandable which provide any kind of model shape. When non-use, it can be shrink the air and getting the flat and small volume for the convenience of package, transportation and storage. Thus the products produced according to the present invention are able to reach highly economic and effective.

The present invention provides the different combination among the assemblies. Such combination is composed from filling air body, lighting device and firm device. The characteristic is this filling air body compose by soften plastic become a gas room into any model shapes after expand filling air and small volume after shrink the air. This expandable and shrinkable filling air body has central area inside that has a capacity for the lighting device and the firm device which firm on the central area. The expand and shrink filling air body reveal any model shapes when the lighting device to radiate.

The characteristic for the expandable filling air decorative lighting string is having a central area through one end to another. One end of both ends has the open mouth on the edge.

The expandable filling air decorative lighting string which has many lighting bulbs joint as series-parallel or parallel-series, among one end firm on the firming device joint many light bulbs in the central area of the expand and shrink filling air body.

The expandable filling air decorative lighting string which is a expandable and shrinkable filling air body. Such as tree shape decorative lighting string through the central area from top to bottom and the open mouth on top and bottom. This firming device such as tree shape decorative lighting string is using one end of the lighting string firm on the top of the tree shape decorative lighting string. This lighting string facing up the open mouth in the central area, this lighting string hang on the central area from the top to bottom and come out from the open mouth at the bottom.

The expandable filling air decorative lighting string which has expand filling air body on the central area among one end or bother ends has the open mouth area and the firm device has the stand which in sequence or simultaneously assemble in firm device with the lighting bulb on the open mouth area and let the light bulb in the central area.

The expandable filling air decorative lighting string which has expand filling air body such as Santa Claus shape through from the waist to the central area. Two ends simultaneously have become an open area let the light bulb device firm on the stand in the central area.

The present invention relates to a decorative filling air light string which composed with expand and shrink filling air, lighting and firm device, wherein the used clamping mean having expand filling air in the gas room which made up from the soften plastic. It become many kind of shapes after expanded filling air, and minimize the volume after emit the air. It has a firm device on top of the expand and shrink filling air body where lighting device is compose from many light bulbs are joint with series-parallel or parallel-series connection. One end of the light string firm on the firm device light string to hang beside expand and shrink filling air body from top to bottom.

The expandable and shrinkable filling air decorative lighting string, lighting device wherein the used expand and shrink filling air body with hollow on the top which firm device such as pan cover has protrude and hole in the central. Let the lighting string through the central hole and firm the protrude on the hollow hole and to hang the lighting string from the top to the bottom.

The expandable and shrinkable filling air decorative lighting string, lighting device wherein the used expand and shrink filling air body such as snowman shape with hollow on the top which firm device let the lighting string firming on the top and the other end hang from the top to the bottom.

The present invention effects: the present invention relates expand filling air decorative lighting string which compose by the expandable and shrinkable filling air body, string device and firming device. This expandable and shrinkable filling air body composed by the soften plastic then become a sufficient gas room. It become any kind of model shapes after expand filling air and minimize the volume after shrink the air. In side the expandable and shrinkable filling air body which do not have the central area to fit in the lighting device. This lighting device is compose from one or many lighting string and firm on the central area. This lighting device is compose from many lighting string series-parallel or parallel-series firm on the top of this volume hang from top to the bottom. It can become into many shapes with expandable and shrinkable filling air body that has multi effects, multi functions and multi variations decorative lighting string.

The present invention relates to an expandable, shrinkable lighting string unit. It can become huge three-dimensional lighting string by expand filling air. Further, after shrinkage, the volume become small and convenient to package, transportation and store. Therefore can reach high economically.

Other objects and features will become apparent when the description of preferred embodiments is taken in conjunction with the annexed drawings.

DESCRIPTION OF EMBODIMENT ON DRAWINGS

Figure 1:
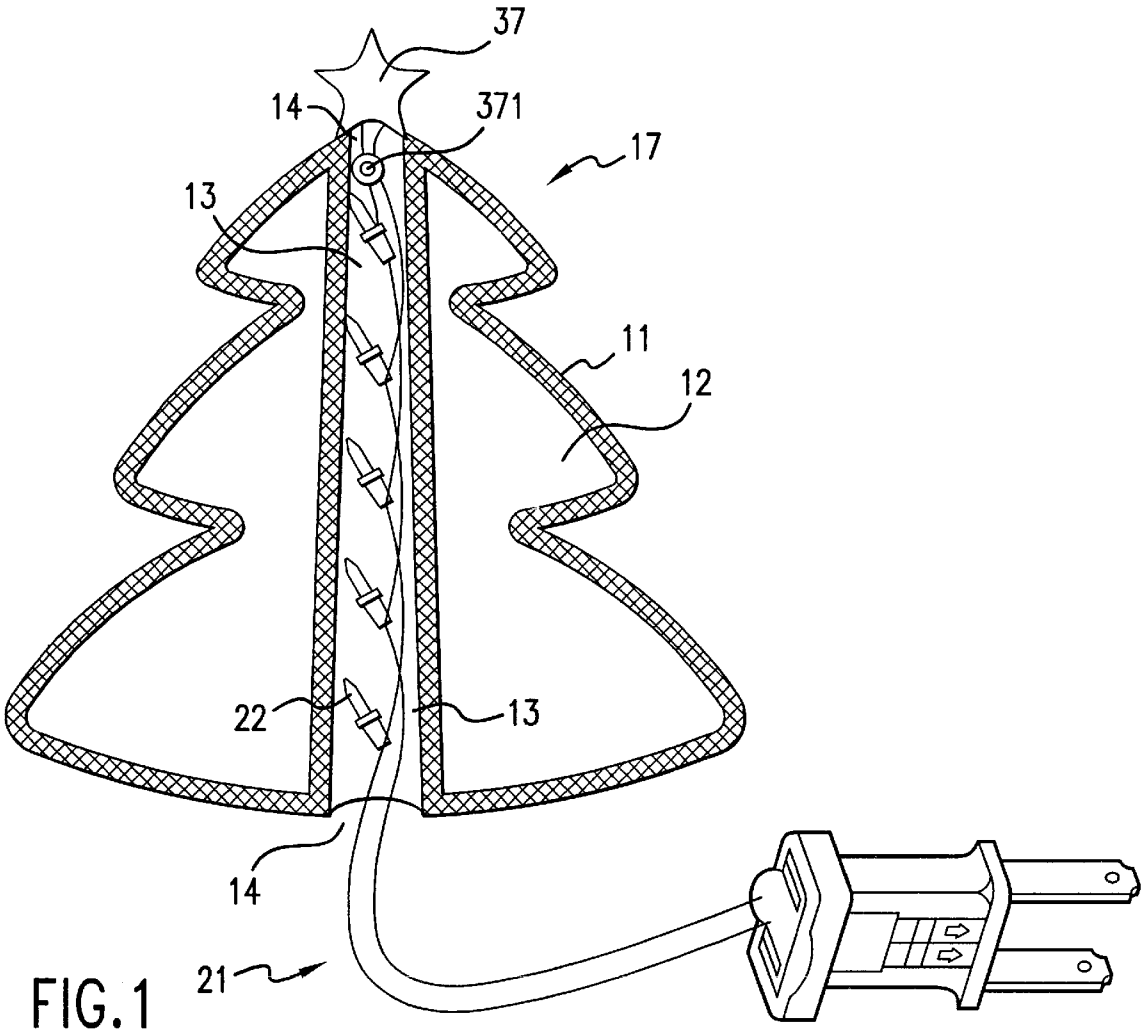
FIG. 1 is showing a tree shape with filling air lighting string of the present invention.

FIG. 1 showing this present invention relates with filling air string unit in decorative lighting string. The present invention lighting string with expandable filling air as in tree shape which composed by different kinds of components. The expandable filling air which composed by slice of soften plastic 11, sufficient gas room 12, central area 13 and the mouth area 14. The lighting device is the lighting string 21 which connect to the light bulb 22. The socket for a light bulb or lamp stand joint and connect via wire to the source. The decorative of treetop 37 has the treetop firm device stand 371 use the lighting string 21 firm in the central area 13 top lock 2 tree in the fillister 15. There is an open mouth area 14 which locate in between top and bottom between the central area 13 which easier for lighting string 21 to go through. The slice soften plastic 11 will seal up the mouth by any kind of shapes. When expand sufficient gas room 12 the whole shape will rise up to become the tree shape 17. After diffuse the air, it minimize the volume and to expand filling air next time while using it.

Figure 2B:
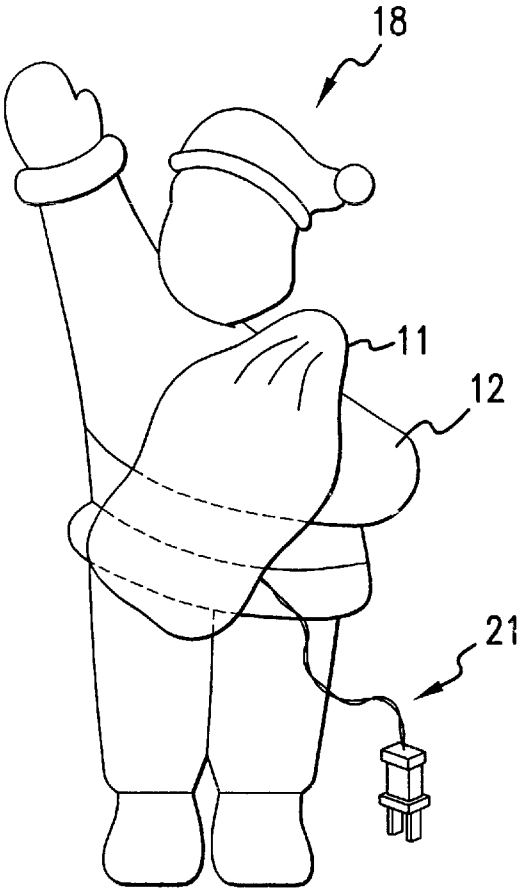
FIG. 2B is showing which back view.
Figure 2A:
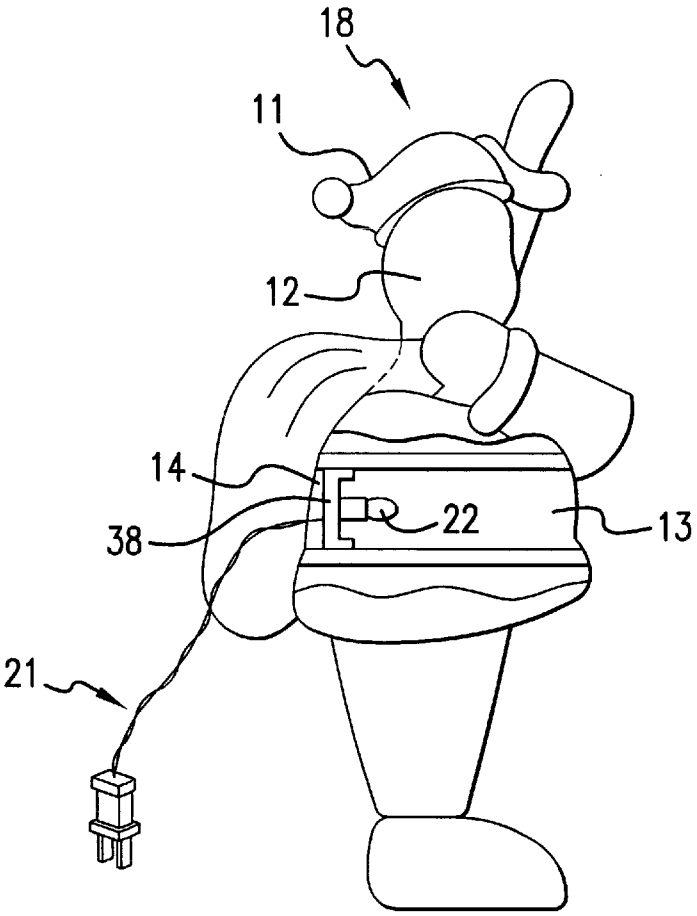
FIG. 2A is showing an exploded view of a Santa Claus type of the decorative lighting string of the present invention.

FIG. 2A is showing an exploded view of a Santa Claus type of the decorative lighting string of the present invention. The Santa Claus shape 18 is composed by using an slice of expandable soften plastic 11, sufficient gas room 12, central area 13, the mouth area 14. The lighting device is light bulb 22 firm on the light stands 38 and connects through the wire to the source. The light stand 38 is firm on the mouth area 14 firm in the central area 13. The lighting shape become Santa Claus present 18 after expand filling air. The mouth area 14 covers by the present string only showing the light bulb's wire.

Figure 3A:
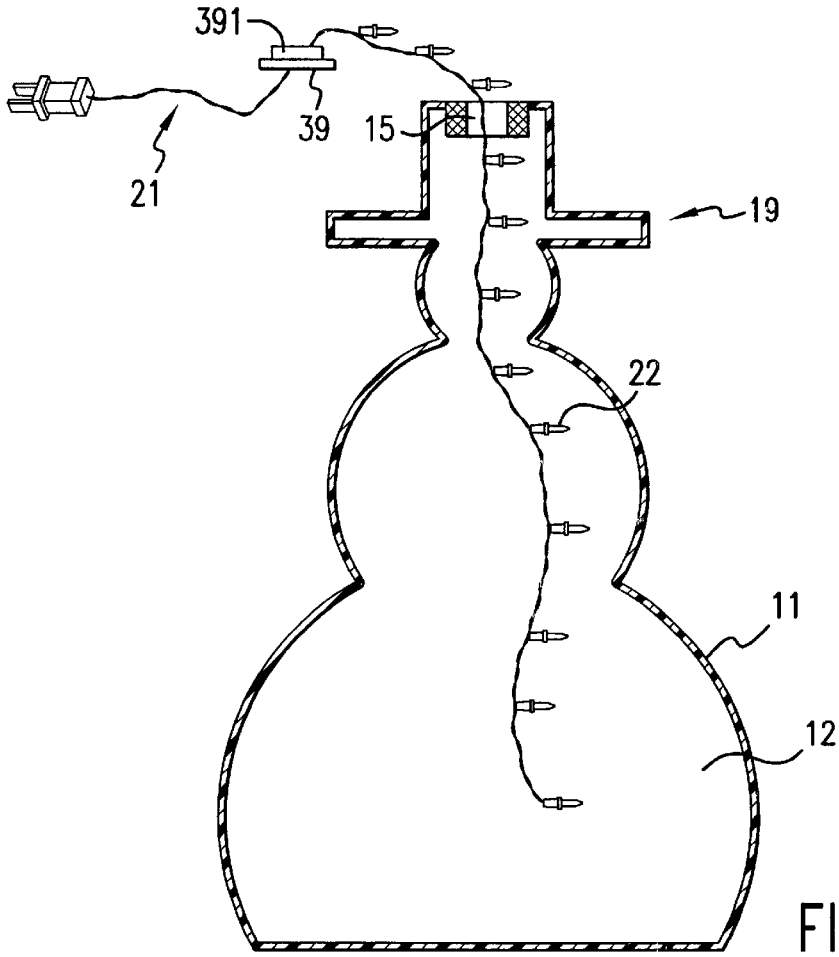
FIG. 3A is showing the side view of a snowman type of the decorative lighting string of the present invention.
Figure 3B:
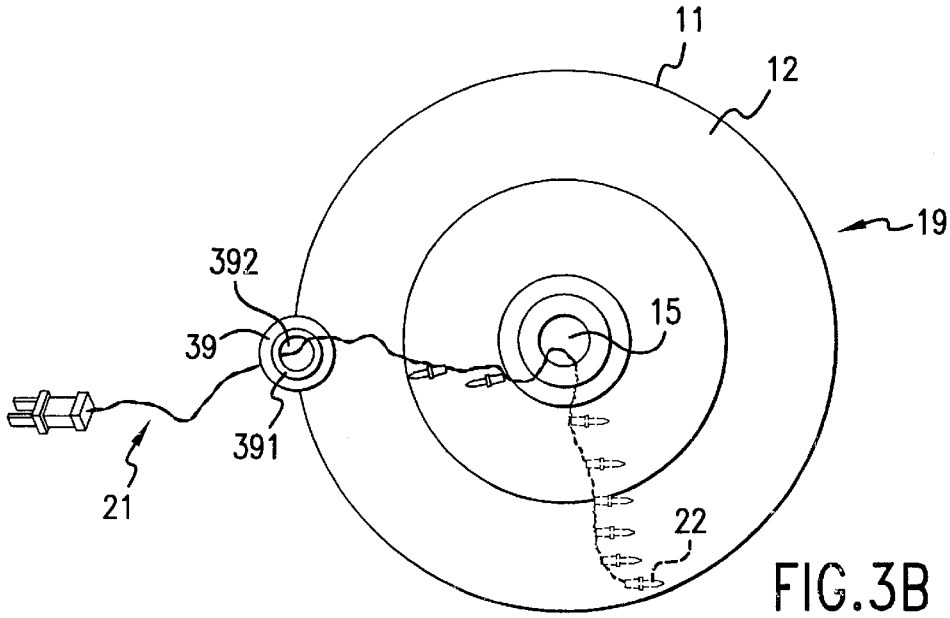
FIG. 3B is showing disperse view from the top.

FIG. 3A is showing the side view of a snowman type of the decorative lighting string of the present invention. The snowman shape 19 composed by the filling air via slice of soften plastic, sufficient gas room 12, central area 13, the mouth area 14. It has a hollow hole 15 on the top of this filling air body. It to have a capacity of firm device which showing in FIG. 3B. FIG. 3B showing the pan cover light stand 39, lighting device is light bulb 22, the socket for a light bulb or lamp stand are joint by middle wire through the firm device to the pan cover light stand 39 to the source. It become snowman type of the decorative lighting string after filling air. FIG. 3B is the snowman type 19 by viewing from the top, the lighting string through the central hole 392 of the pan cover light stand 39. There is a hollow hole 15 on the top of the snowman to be able to cover the pan cover light stand 39 and firm in the hollow. It has a protrude area 391 on the top of the pan cover light stand 39. The protrude area that just cover on the hollow hole 15 when composing the lighting string.

Figure 4:
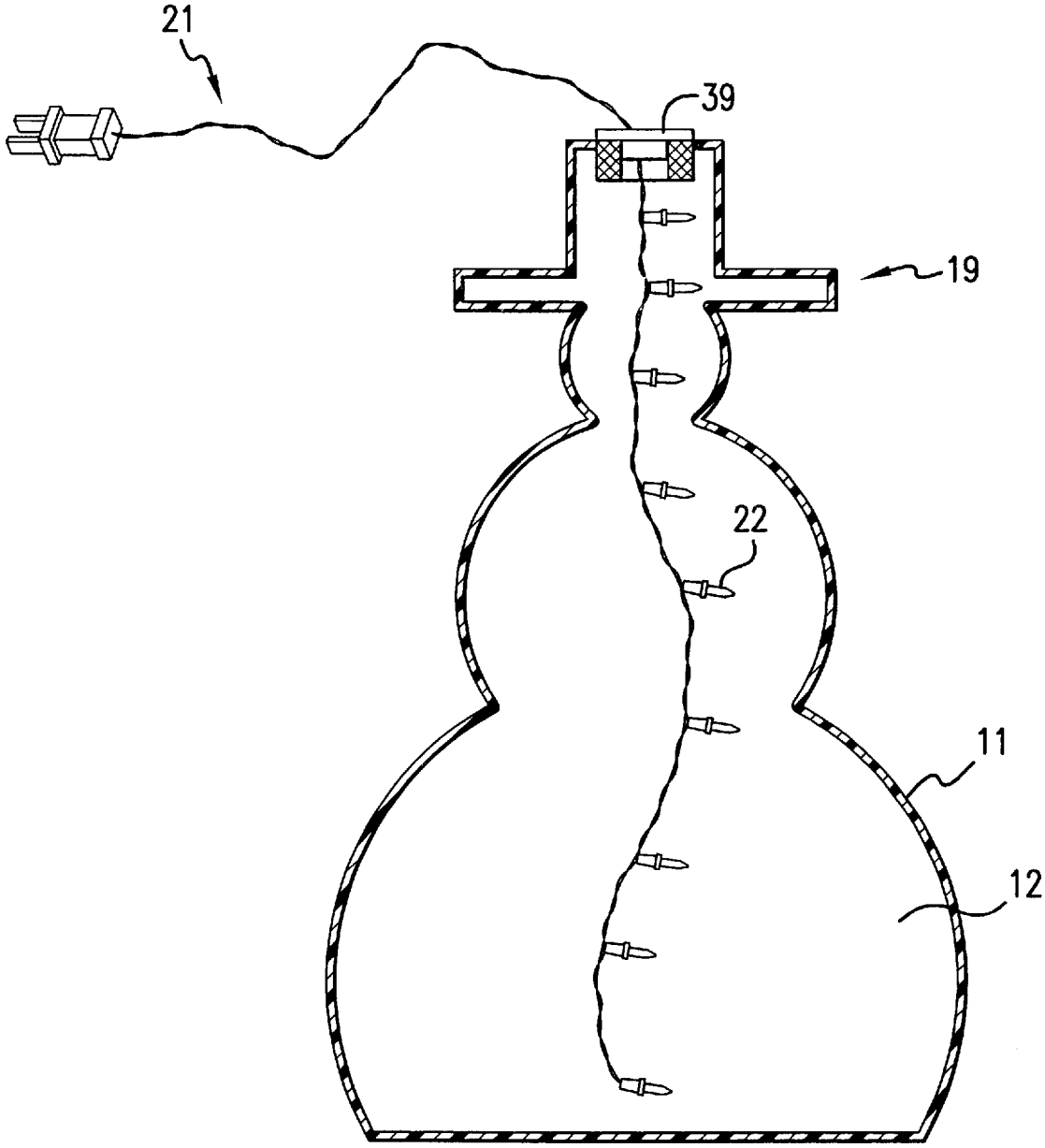
FIG. 4 is showing the complete expanding filling air lighting string view of the present invention.

FIG. 4 is showing the complete expanding filling air lighting string view of the present invention. The snowman shape 19 expanded filling air, the pan cover light stand 39 is fixed in the snowman's hollow hole. The lighting device lighting string 21, light bulb 22, the socket for a light bulb or lamp stand are joint by the wire and connect it to the source. The slice of soften plastic 11, sufficient gas room 12 will become snowman shape after expanded filling air the body.

The features and preferred embodiments of the present invention have been described in the foregoing specification. The invention intended to be protected herein, however, is not to be constructed as limited to the particular forms disclosed. Variations and changes which may be made by those skilled in the art are with out departing from the scope of the present invention.

LIST OF REFERENCE NUMERALS

1 expandable filling air body
11 slice soften plastic
12 sufficient gas room
13 central area
14 mouth area
15 hollow hole
17 tree shape
18 Santa Claus shape
19 snowman shape
2 lighting device
21 lighting string
22 light bulb
3 firm device
37 decorative of treetop
371 treetop firm device stand
38 light stand
39 pan cover light stand
391 protrude area
392 central hole

What is claimed is:

1. An inflatable decorative lighting string, comprising:

a) an inflatable decorative form three dimensional body;

b) an opening formed in said body extending therethrough in a substantially axial direction forming at a first axial end a first opening mouth and at a second axial end a second opening mouth, said opening forming a through space in said body;

c) a lighting string consisting of a plurality of spaced apart lighting bulbs having a first end and extending from said first opening mouth in said body through the space formed in said body to a second end disposed at said second opening mouth, the source wire for said lighting string extending from said lighting string second end through said second opening mouth for connection to a voltage source; and d) a decoration associated with said decorative form three dimensional body attached thereto at said first opening mouth and having connected thereto the first end of said lighting string so as to support said lighting string in said space in said body.

* * * * *